US008040290B2

(12) United States Patent
Kang et al.

(10) Patent No.: US 8,040,290 B2
(45) Date of Patent: Oct. 18, 2011

(54) MOUNTING BRACKET FOR SATELLITE DISH ANTENNA AND SATELLITE DISK ANTENNA ASSEMBLY USING THE SAME

(75) Inventors: Hung Yi Kang, Tanzih Township, Taichung County (TW); Hung Jui Kang, Tanzih Township, Taichung County (TW)

(73) Assignee: Janky Technology Co., Ltd., Taichung (TW)

( * ) Notice: Subject to any disclaimer, the term of this patent is extended or adjusted under 35 U.S.C. 154(b) by 333 days.

(21) Appl. No.: 12/465,375

(22) Filed: May 13, 2009

(65) Prior Publication Data

US 2010/0289718 A1 Nov. 18, 2010

(51) Int. Cl.
*H01Q 3/02* (2006.01)

(52) U.S. Cl. ..... 343/882; 343/892

(58) Field of Classification Search ..... 343/840, 343/878, 882, 890, 891, 892
See application file for complete search history.

(56) References Cited

U.S. PATENT DOCUMENTS 6,734,830 B1 * 5/2004 Bickham ..... 343/880
7,456,802 B1 * 11/2008 Bourgeois ..... 343/878
7,880,682 B2 * 2/2011 Fruh et al. ..... 343/757

* cited by examiner

*Primary Examiner* — Tan Ho
(74) *Attorney, Agent, or Firm* — Chun-Ming Shih

(57) ABSTRACT

An exemplary mounting bracket for a satellite dish antenna includes a mounting base, a first frame and a second frame. The first frame includes a pivoting portion at one end thereof. The pivoting portion is pivoted to one side of the mounting base so that the pivoting portion is capable of rotating from a horizontal position to a vertical position. The second frame includes a pivoting portion at one end thereof. The pivoting portion is pivoted to another opposite side of the mounting base so that the pivoting portion being capable of rotating from a horizontal position to a vertical position. The mounting bracket can be changed from the extending state to the folding state. The mounting bracket in the extending state can be mounted on a plane. The mounting bracket in the folding state can be mounted on various objects by cooperating with various fixing devices.

20 Claims, 13 Drawing Sheets

MOUNTING BRACKET FOR SATELLITE DISH ANTENNA AND SATELLITE DISK ANTENNA ASSEMBLY USING THE SAME

BACKGROUND

The present invention relates to a mounting bracket for an antenna and an antenna assembly using the mounting bracket, and particularly to a mounting bracket for a satellite dish antenna and a satellite dish antenna assembly using the mounting bracket.

A satellite dish antenna is a type of parabolic antenna designed to receive microwave signals from communications satellites, which transmit data transmissions or broadcasts, such as satellite television. Generally, the satellite dish antenna is mounted by use of a mounting bracket so that stable microwave signals can be received. The satellite dish antenna can be mounted on an object, for example, a plane (e.g., the ground, a roof and a wall), an edge of a plate (e.g., an edge of a table top), a mast, and so on. However, a typical mounting bracket only has a single mounting function so that the typical mounting bracket can only be mounted on an object having a corresponding structure. That is, a sort of mounting bracket can only be mounted on a plane, a sort of mounting bracket can only be mounted on an edge of a plate, and a sort of mounting bracket can only be mounted on a mast. Thus, the mount of the satellite dish antenna is limited by the structure of the mounting bracket. Particularly, when a user is in a trip, the user can not find a suitable object corresponding to the mounting bracket anywhere. Thus, the satellite dish antenna can not be mounted by use of the typical mounting bracket conveniently, thereby causing some troubles of using the satellite dish antenna.

Therefore, what is needed is a mounting bracket having a number of mounting functions for a satellite dish antenna to overcome the disadvantages of the typical mounting bracket described above.

BRIEF SUMMARY

The present invention provides a mounting bracket having a number of mounting functions for a satellite dish antenna.

The present invention also provides a satellite dish antenna assembly using the mounting bracket having a number of mounting functions.

The present invention provides a mounting bracket for a satellite dish antenna. The mounting bracket includes a mounting base for mounting the satellite dish antenna thereon, a first frame and a second frame. The first frame includes a pivoting portion at one end thereof. The pivoting portion is pivoted to one side of the mounting base so that the pivoting portion is capable of rotating from a horizontal position to a vertical position. The second frame includes a pivoting portion at one end thereof. The pivoting portion is pivoted to another side of the mounting base opposite to the one side of mounting base so that the pivoting portion being capable of rotating from a horizontal position to a vertical position. The first frame and the second frame are capable of rotating in the horizontal position simultaneously by rotating the respective pivoting portion, thereby making the mounting bracket in an extending state. The first frame and the second frame are also capable of rotating in the vertical position simultaneously by rotating the respective pivoting portion, thereby making the mounting bracket in a folding state.

In one aspect, the mounting bracket further includes a fixing device configured for cooperating with the mounting bracket in the folding state to mount the satellite dish antenna on an edge of a plate. The fixing device includes an upper clamping member located on the mounting bracket in the folding state, the upper clamping having a first rim and a second rim, the first rim and the second rim attaching to two opposite sides of the mounting bracket in the folding state; a lower clamping member located on a bottom surface of the plate; and a coupling rod for connecting the upper clamping member and the lower clamping member, the coupling rod comprising a bending portion, an upper portion upwardly vertically extending from the upper end of the bending portion and a lower portion transversely horizontally extending from the lower end of the bending portion, the lower portion being installed in the lower clamping member, the bending portion being around the edge of the plate, the upper portion passing through the mounting bracket in the folding state and the upper clamping member, and the upper portion having a screw thread section for cooperating with a screw cap so as to fasten the fixing device.

In another aspect, the mounting bracket further includes a fixing device configured for cooperating with the mounting bracket in the folding state to mount the satellite dish antenna on a surface of a vertical plate. The fixing device includes a sucker and a control member having a hanging latch, the first frame further comprises an erect portion substantially vertical thereto, the second frame further comprises an erect portion substantially vertical thereto, the two erect portions face to each other, and a hanging groove corresponding to the hanging latch is defined between the two erect portions and configured for hanging the hanging latch of the control member.

In still another aspect, the mounting bracket further includes a fixing device configured for cooperating with the mounting bracket in the folding state to mount the satellite dish antenna on a mast, the fixing device comprises a U-shaped screw and two corresponding screw caps, the first frame further comprises an erect portion substantially vertical thereto, a corner of the erect portion of the first frame is cut out along the extending direction of the erect portion of the first frame, thereby forming an attaching portion at an inner side of the erect portion of the first frame, the second frame further comprises an erect portion substantially vertical thereto, a corner of the erect portion of the second frame is cut out along the extending direction of the erect portion of the second frame, thereby forming an attaching portion at an inner side of the erect portion of the second frame, the two erect portions face to each other, the U-shaped screw and the two erect portion cooperate for surrounding the mast so that the mast attach to the two attaching portion of the two erect portions, and the U-shaped screw is cooperated with the corresponding screw caps so as to fasten the mounting bracket in the folding state on the mast.

The first frame includes a transverse portion and a slant portion, the pivoting portion of the first frame extends from the slant portion, the slant portion of the first frame is located between the pivoting portion and the transverse portion of the first frame, the second frame comprises a transverse portion and a slant portion, the pivoting portion of the second frame extends from the slant portion of the second frame, and the slant portion of the second frame is located between the pivoting portion and the transverse portion of the second frame.

The mounting bracket in the folding state has two surfaces facing to each other, the two surfaces have a plurality of cushions disposed thereon, the cushions is configured for forming a gap between the first frame and the second frame when the mounting bracket is in the folding state, and the cushions is also configured for attaching to a plane when the mounting bracket is in the extending state.

The mounting base defines a hole, the hole is configured for installing the satellite dish antenna therein so that the satellite dish antenna is capable of rotating in 360 degrees in the hole, a fastening screw is disposed at a side of the mounting base and configured for fastening the satellite dish antenna in the hole.

The mounting bracket can be changed from the extending state to the folding state. The mounting bracket in the extending state can be mounted on a plane. The mounting bracket in the folding state can be mounted on an edge of the plate, a surface of the plate or a mast by cooperating with various fixing devices. Accordingly, the mounting bracket of the satellite dish antenna assembly has a number of mounting functions.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
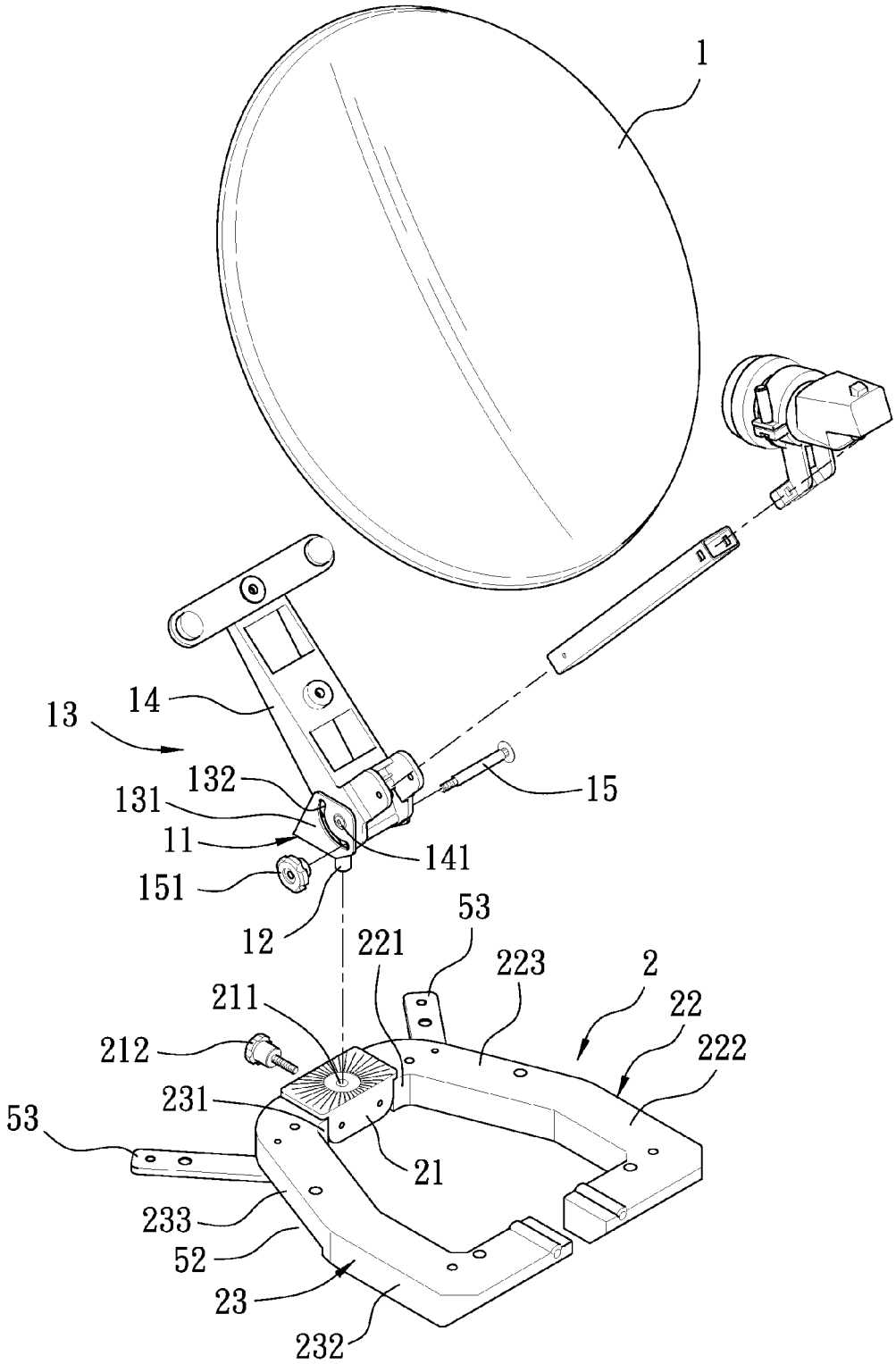
FIG. 1 is an exploded view of a satellite dish antenna assembly in accordance with a preferred embodiment of the present invention.
Figure 1A:
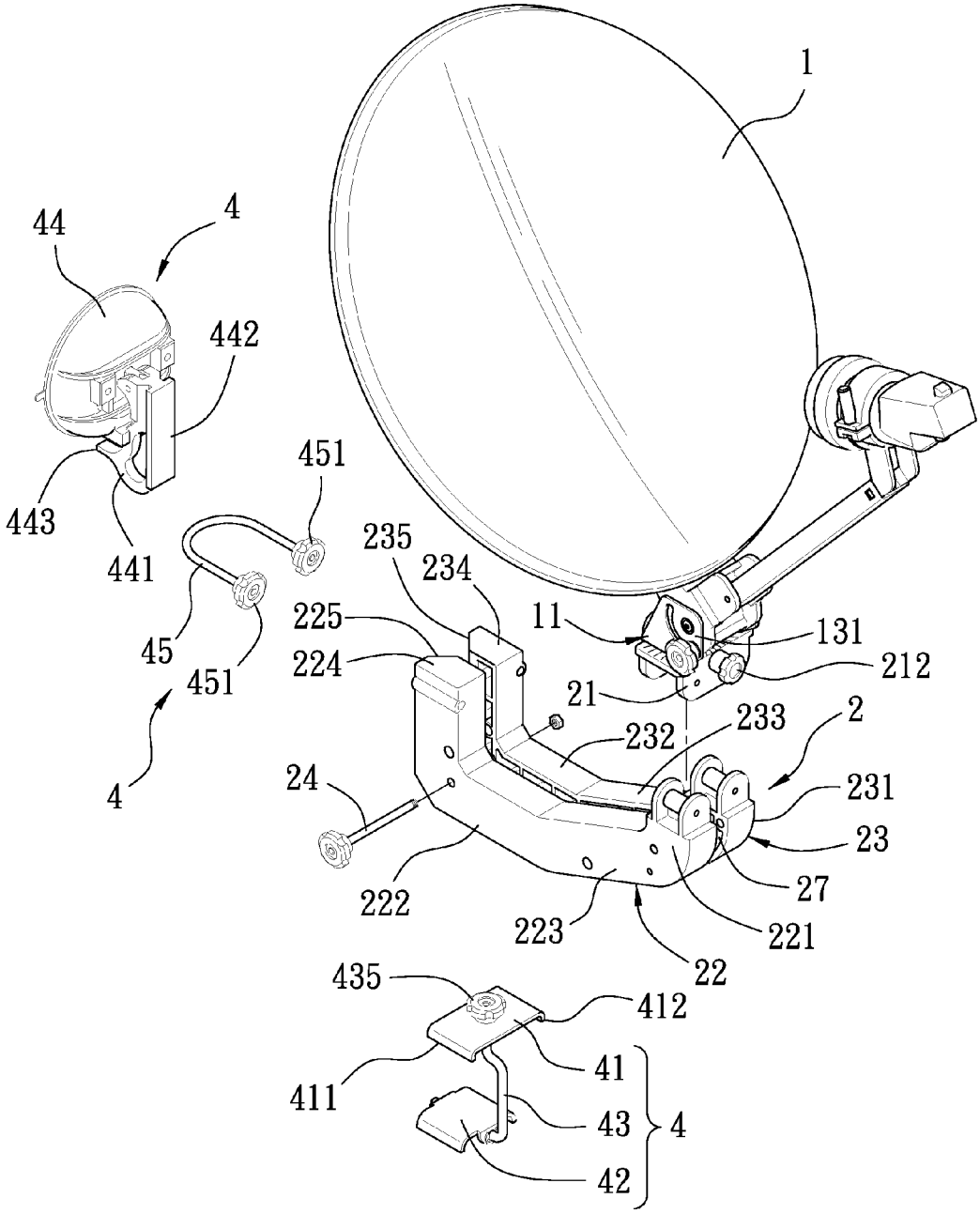
FIG. 1A is an exploded view of the satellite dish antenna assembly and fixing devices in accordance with another preferred embodiment of the present invention.
Figure 1B:
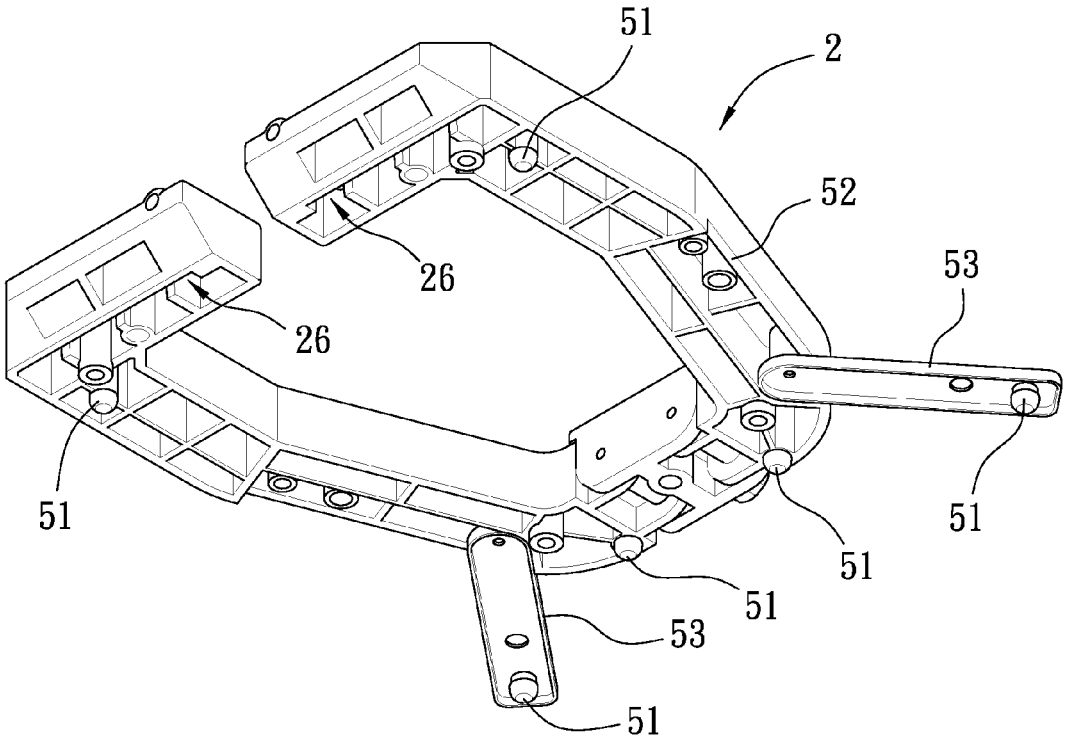
FIG. 1B is a bottom view of the mounting bracket in an extending state in accordance with a preferred embodiment of the present invention.
Figure 1C:
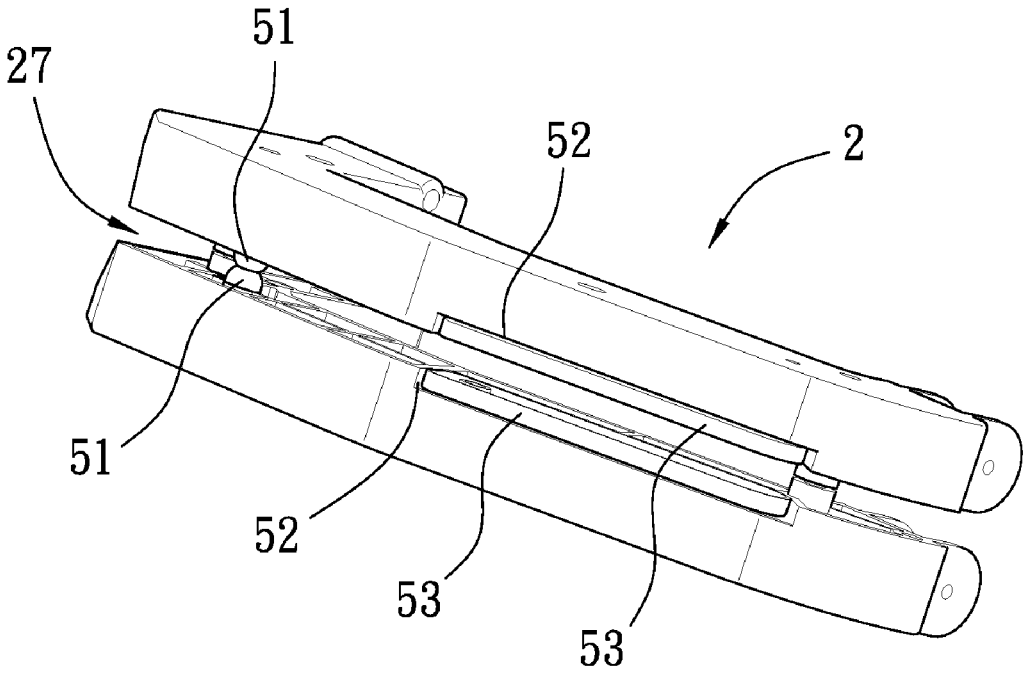
FIG. 1C is a bottom view of the mounting bracket in a folding state in accordance with a preferred embodiment of the present invention.

Referring to FIG. 1, a satellite dish antenna assembly includes an antenna 1 and a mounting bracket 2 for coupling to the antenna 1 in accordance with the preferred embodiment of the present invention. Referring to FIG. 1A, the antenna 1 has an antenna base 11. A shaft 12 connects to the bottom of the antenna base 11. An adjusting mechanism 13 for adjusting an elevation angle of the antenna 1 is located between the antenna 1 and the antenna base 11. The adjusting mechanism 13 connects to the antenna 1 and the antenna base 11 respectively. The adjusting mechanism 13 includes a pair of symmetrical bearing plates 131, a bearing arm 14 and a locking screw 15. Each of the bearing plate 131 defines an arc-shaped elongate hole 132. The bearing arm 14 is configured for supporting and fixing the antenna 1. A rotating shaft 141 acts as a pivot and is configured for connecting the bearing arm 14 to the bearing plates 131. Thus, the bearing arm 14 is rotatably coupled to the pair of bearing plates 131 via a rotating shaft 141. The locking screw 15 has a screw cap 151 cooperating therewith. The locking screw 15 passes through the bearing arm 14 and the arc-shaped elongate holes 132 of the bearing plates 131. As a result, the locking screw 15 can be movable in the arc-shaped elongate holes 132 and the bearing arm 14 can be rotatable relative to the antenna base 11. During rotating, the rotating shaft 141 acts as a pivot and the locking screw 15 moves in the arc-shaped elongated holes 132. The rotation of the bearing arm 14 relative to the antenna base 11 is configured for adjusting the elevation angle of the antenna 1. Then, the locking screw 15 cooperates with the screw cap 151 to fix the antenna 1 in a certain position with a suitable elevation angle. The antenna 1 is a known technology and it is not described here.

Referring to FIGS. 1, 1A~1C, the mounting bracket 2 includes a mounting base 21, a first frame 22 and a second frame 23. The mounting bracket 2 is configured for mounting the antenna on an object.

The mounting base 21 is configured for coupling to the antenna 1 so that the antenna 1 is mounted on the mounting bracket 2. A hole 211 is defined in the top portion of the mounting base 21 and a fastening screw 212 is disposed at a side of the mounting base 21. The shaft 12 at the bottom of the antenna base 11 inserts into the hole 211 and is configured for rotating in 360 degrees in the hole 211. The fastening screw 212 is screwed to attach to the shaft 12 in the hole 211 so as to fix the shaft 12 when the antenna 1 is adjusted to a suitable position by rotating the shaft 12.

The first frame 22 includes a pivoting portion 221, a transverse portion 222 and a slant portion 223. The pivoting portion 221 is located at one end of the first frame 22. The transverse portion 222 is located at another end of the first frame 22. The slant portion 223 connects to the pivoting portion 221 and the transverse portion 222 respectively. That is, the pivoting portion 221 extends from the slant portion 223 and the slant portion 223 is located between the pivoting portion 221 and the transverse portion 222. The pivoting portion 221 is pivoted to one side of the mounting base 21 so that the first frame 22 can be rotated from a horizontal position to a vertical position.

Further, the second frame 23 includes a pivoting portion 231, a transverse portion 232 and a slant portion 233. The pivoting portion 231 is located at one end of the first frame 23. The transverse portion 232 is located at another end of the second frame 23. The slant portion 233 connects to the pivoting portion 231 and the transverse portion 232 respectively. That is, the pivoting portion 231 extends from the slant portion 233 and the slant portion 233 is located between the pivoting portion 231 and the transverse portion 232. The pivoting portion 231 is pivoted to another side of the mounting base 21 opposite to the one side of the mounting base 21 so that the second frame 23 can be rotated from a horizontal position to a vertical position.

Figure 2:
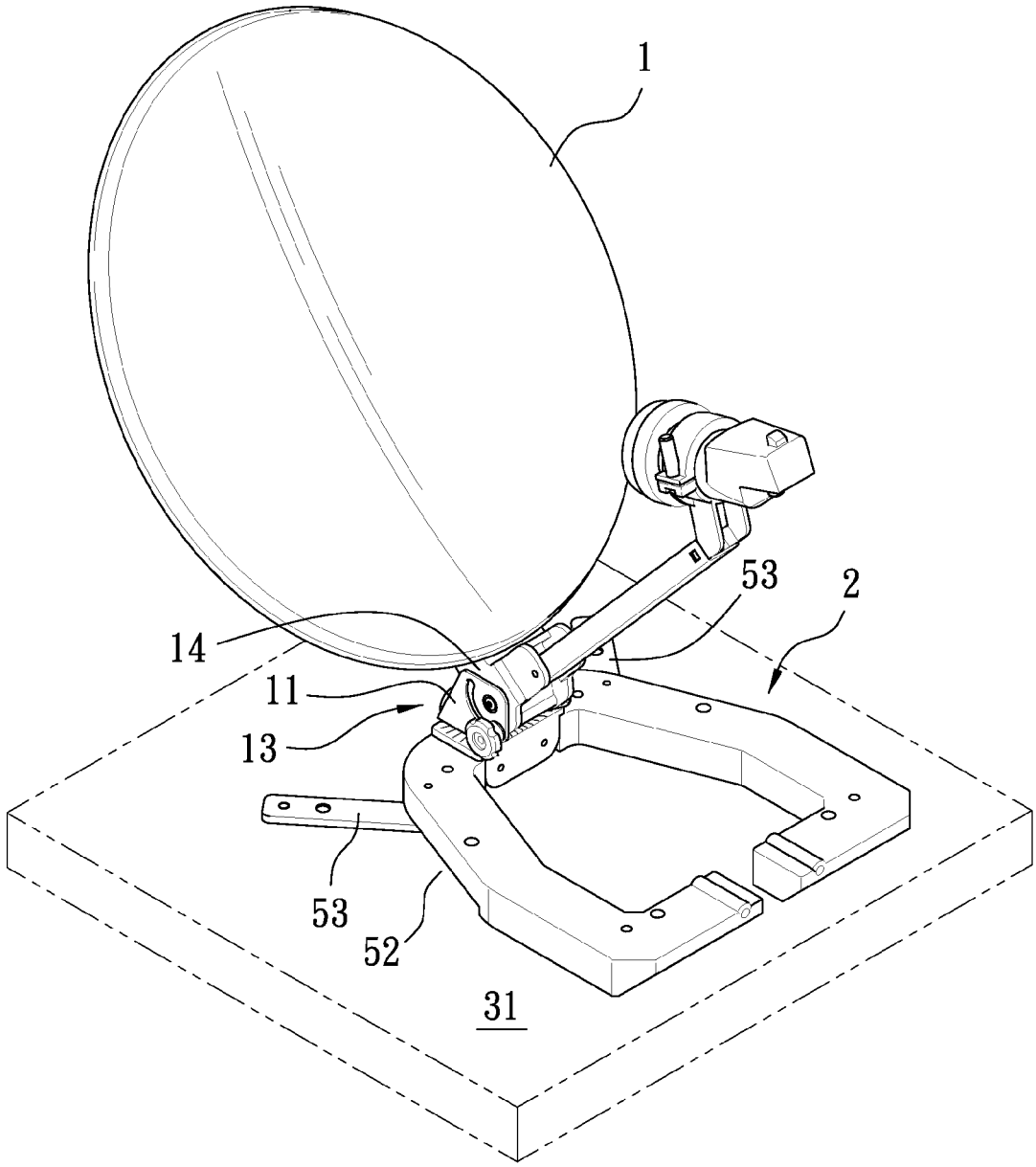
FIG. 2 is a schematic view of a satellite dish antenna assembly in accordance with a preferred embodiment of the present invention, which is mounted on a plane by use of the mounting bracket in an extending state.
Figure 3:
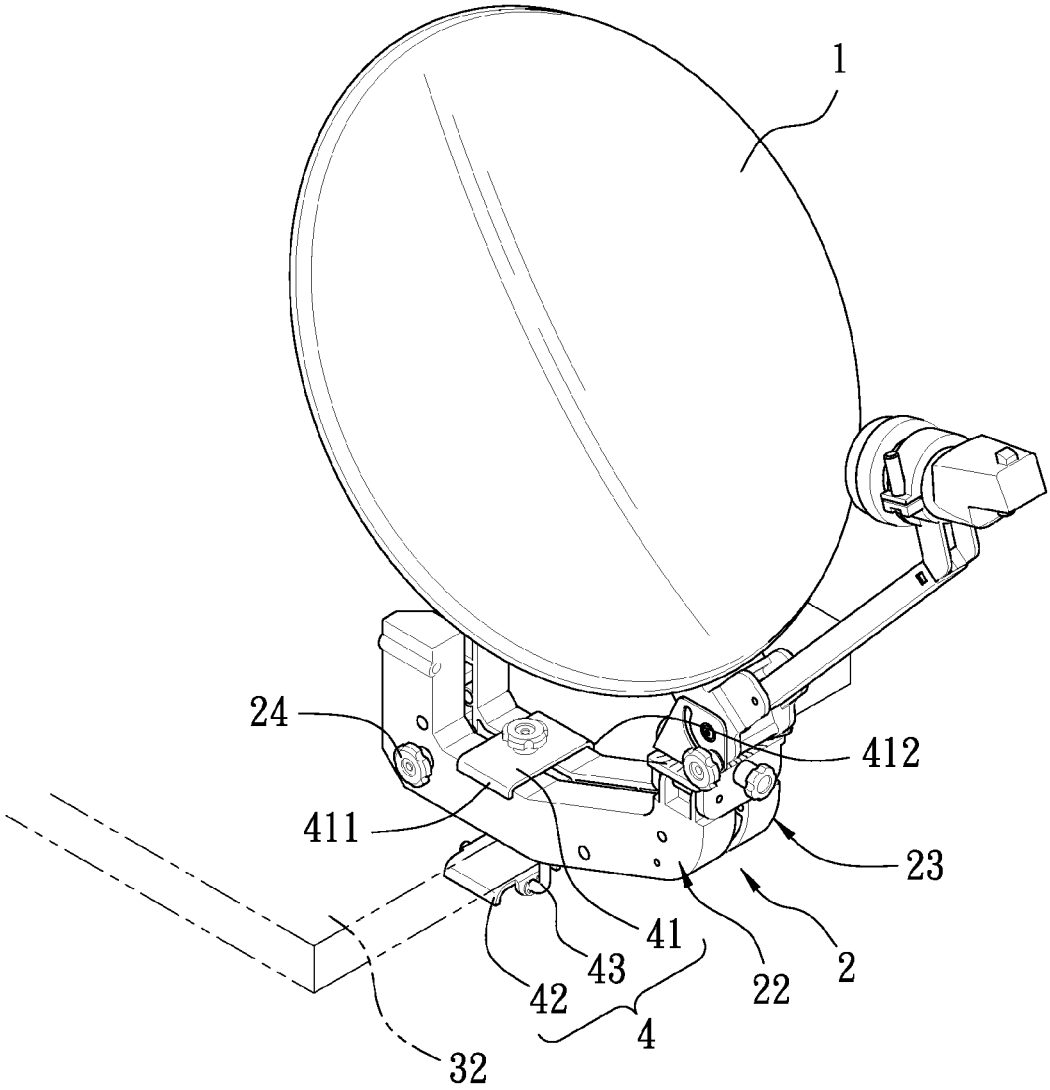
FIG. 3 is a schematic view of a satellite dish antenna assembly in accordance with a preferred embodiment of the present invention, which is mounted on an edge of a plate by use of the mounting bracket in a folding state.
Figure 3A:
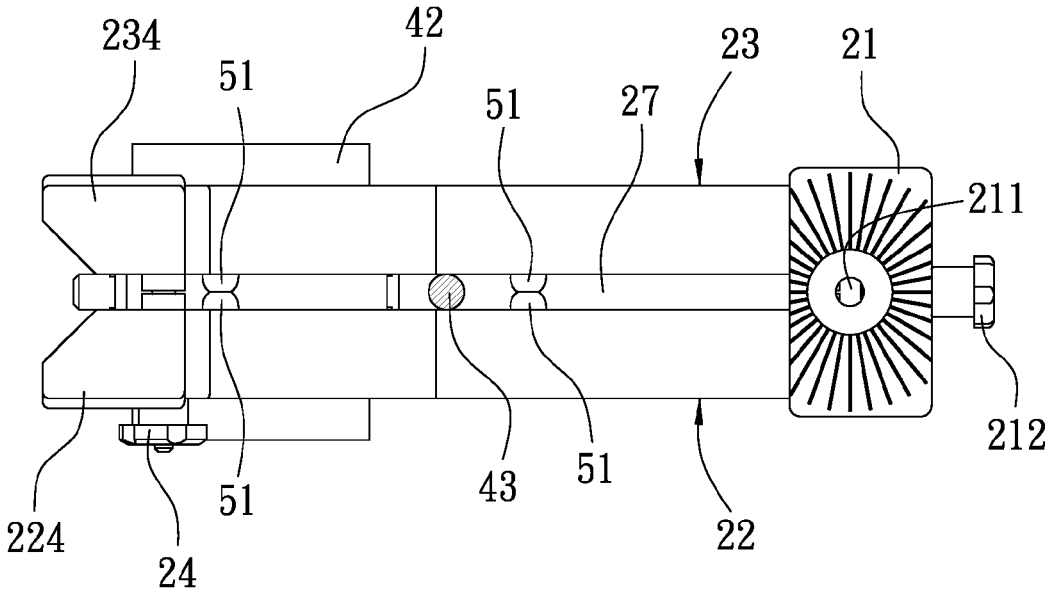
FIG. 3A is a top view of the mounting bracket in the folding state shown in FIG. 3, which is cooperated with a fixing device.
Figure 3B:
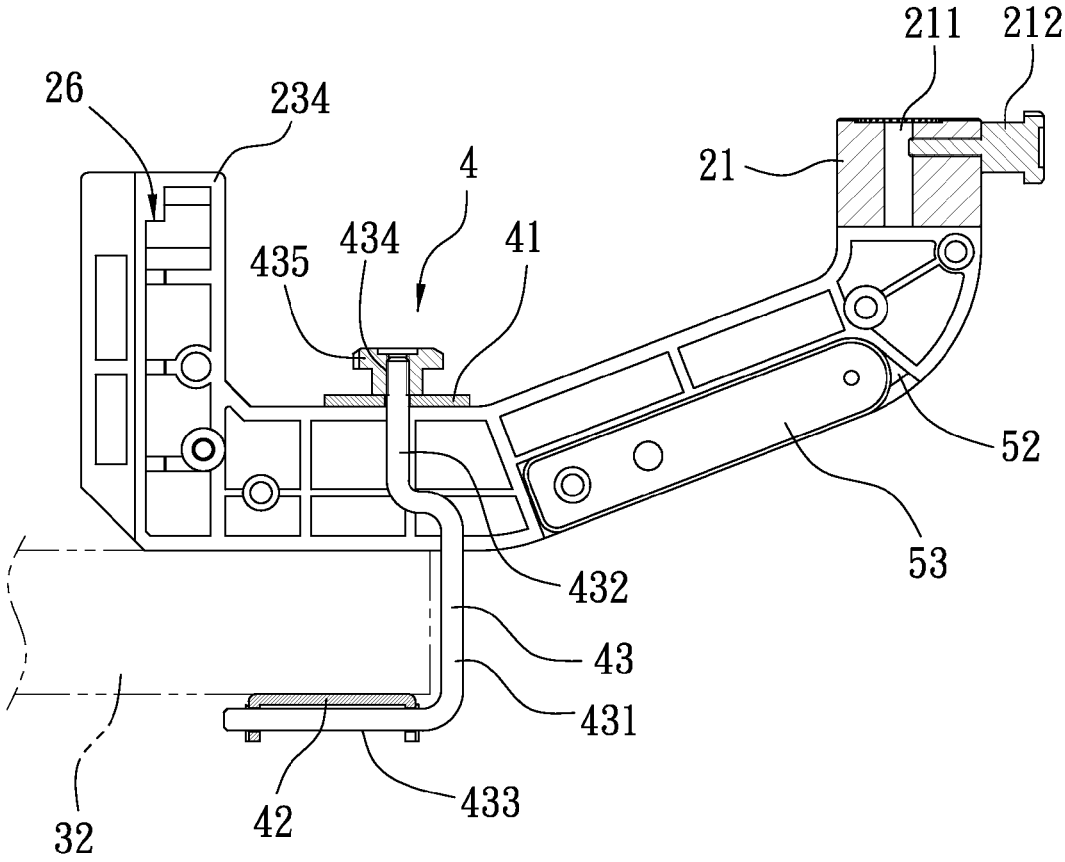
FIG. 3B is a cross-sectional view of the mounting bracket mounted on an edge of a plate, which is cooperated with a fixing device.

Referring to FIG. 2, in the illustrated embodiment, when the first frame 22 and the second frame 23 are both in the horizontal position simultaneously by rotating the respective pivoting portion 221, 231 pivoted to the two opposite sides of the mounting base 21, the mounting bracket 2 is in an extending state. Thus, the mounting bracket 2 in the extending state can be mounted on a plane 31 such as a table top, a flat roof and a vehicle top, and so on.

Additionally, referring to FIGS. 1A, 1C, 3~5, when the first frame 22 and the second frame 23 are both in the vertical position simultaneously by rotating the respective pivoting portion 221, 231 pivoted to the two opposite sides of the mounting base 21, the mounting bracket 2 is in a folding state. Thus, the mounting bracket 2 is in the folding state can be mounted on an object by use of a fixing device 4 (referring to FIGS. 1A, 3~5). Further, a coupling member 24 is configured for coupling and fixing the first frame 22 and the second frame 23 in the vertical position of the mounting bracket 2 is in the folding state. Referring to FIG. 1A, in the illustrated embodiment, the coupling member 24 includes a screw and a corresponding screw cap.

Referring to FIGS. 1A, 3, 3A, 3B, in the illustrated embodiment, the mounting bracket 2 in the folding state can be mounted on an edge of a plate 32 by use of the fixing device 4. In the embodiment, the plate 32 is substantially horizontal. The fixing device 4 includes an upper clamping member 41, a lower clamping member 42 and a coupling rod 43. The upper clamping member 41 is located on the mounting bracket 2 in the folding state. Advantageously, the upper clamping member 41 is located on the transverse portions 222, 232 of the mounting bracket 2 in the folding state. The upper clamping member 41 has a first rim 411 and a second rim 412 opposite to the first rim. The first rim 411 and the second rim 412 are respectively attached to the two opposite sides of the mounting bracket 2 in the folding state. The two sides of the folding mounting bracket 2 are parallel to each other. The lower clamping member 42 is located on a bottom surface of the plate 32. The coupling rod 43 is configured for connecting the upper clamping member 41 and the lower clamping member 42. The coupling rod 43 includes a bending portion 431, an upper portion 432 upwardly vertically extending from the upper end of the bending portion 431 and a lower portion 433 transversely horizontally extending from the lower end of the bending portion 431. The upper portion 432 has a screw thread section 434. The lower portion 433 of the coupling rod 43 is installed in the lower clamping member 42. The bending portion 431 of the coupling rod 43 is located around the edge of the plate 32. The upper portion 431 of the coupling rod 43 passes through the first frame 22 and the second frame 23 of the mounting bracket 2 in the folding state and the upper clamping member 41. Then, a screw cap 435 is cooperated with the screw thread section 434 of the upper portion 432 so as to fasten the fixing device 4 and the mounting bracket 2 in the folding state on the plate 32.

Figure 4:
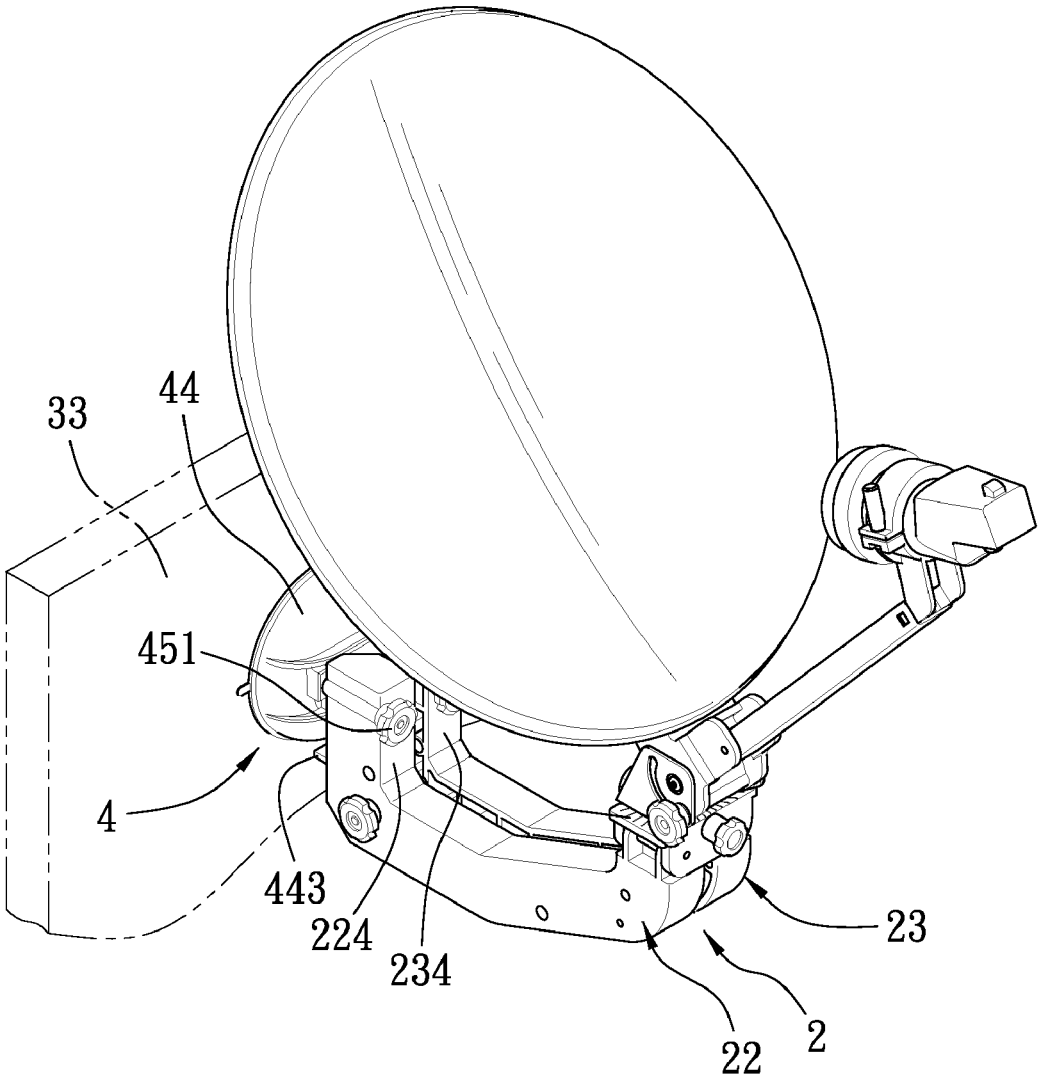
FIG. 4 is a schematic view of a satellite dish antenna assembly in accordance with a preferred embodiment of the present invention, which is mounted on a vertical plate by use of the mounting bracket in a folding state.
Figure 4A:
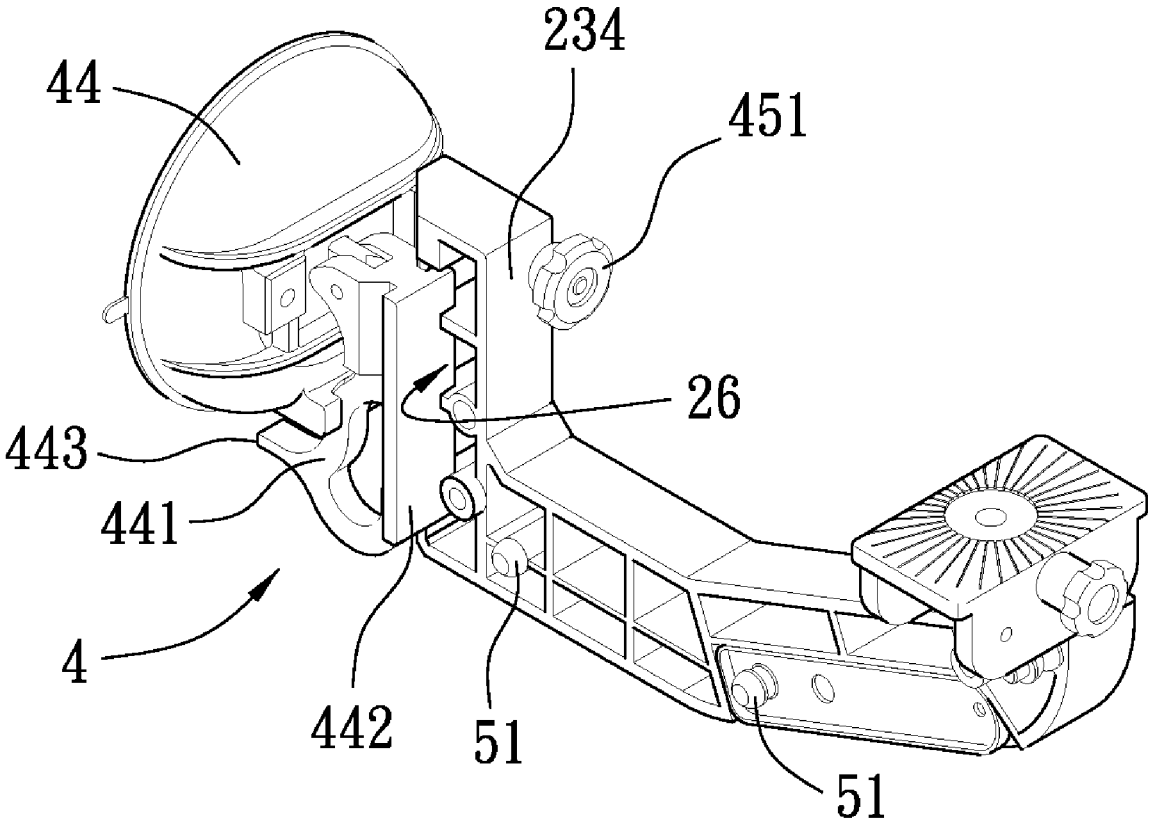
FIG. 4A is a schematic view of the mounting bracket in the folding state (only a second frame is shown) shown in FIG. 4, which is cooperated with the fixing device.
Figure 4B:
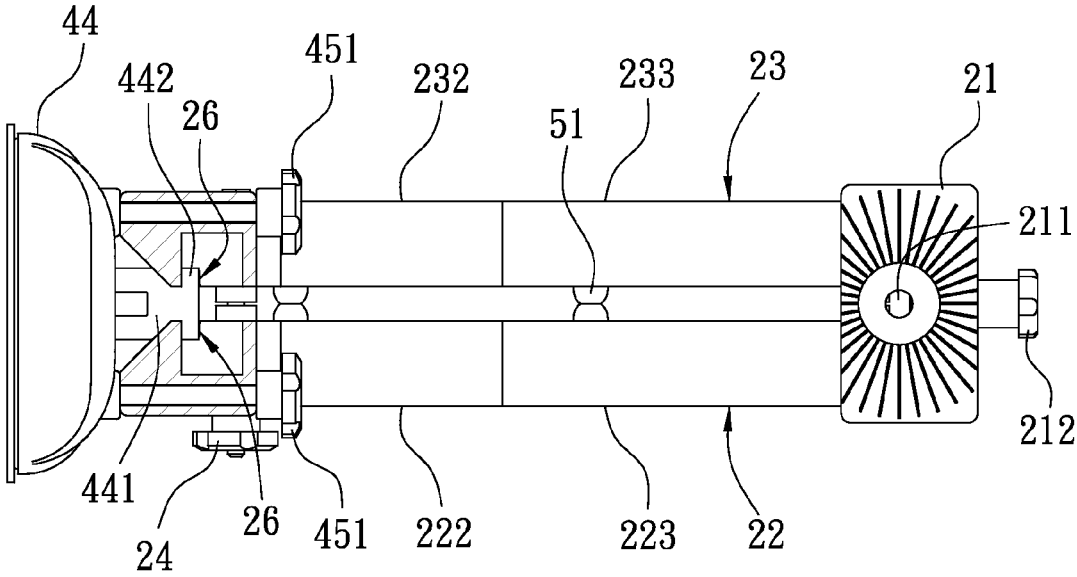
FIG. 4B is a top, partial, cross-sectional view of the mounting bracket in the folding state shown in FIG. 4, which is cooperated with the fixing device.

Referring to FIGS. 4, 4A, 4B, in the illustrated embodiment, the folding mounting bracket 2 can be mounted on a surface of a plate 33 by use of the fixing device 4. In the embodiment, the plate 33 is substantially vertical. Further, referring to FIGS. 1A, 1B, the fixing device 4 includes a sucker 44 and a control member 441 for controlling the production of the vacuum sucking force of the sucker 44. The control member 441 includes a hanging latch 442. The first frame 22 further includes an erect portion 224 connecting to the transverse portion 222. The erect portion 224 is substantially vertical to the transverse portion 222 of the first frame 22. The second frame 23 further includes an erect portion 234 connecting to the transverse portion 232. The erect portion 234 is substantially vertical to the transverse portion 232 of the second frame 23. The two erect portions 224, 234 face to each other. A hanging groove 26 corresponding to the hanging latch 442 is defined between the two erect portions 224, 234. The hanging groove 26 is configured for hanging the hanging latch 442 of the control member 441. In addition, the control member 441 includes a supporting portion 443. The supporting portion 443 extends from the side of the control member 441 near to the sucker 44. When the sucker 44 sucks on the surface of the plate 33, the supporting portion 443 can attach to the surface of the plate 33 so as to increase stability of the antenna 1.

Figure 5:
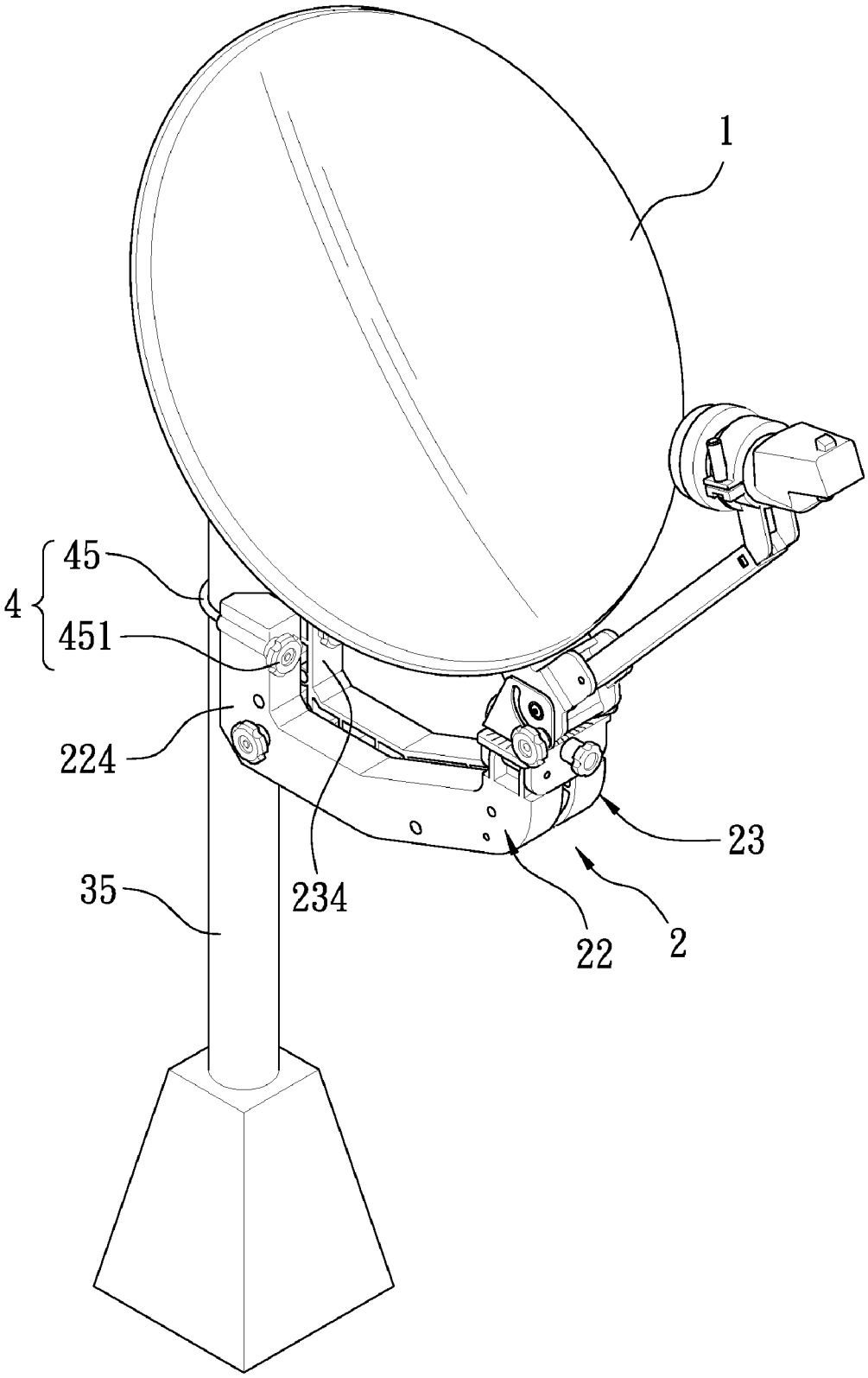
FIG. 5 is a schematic view of a satellite dish antenna assembly in accordance with a preferred embodiment of the present invention, which is mounted on a mast by use of the mounting bracket in the folding state.
Figure 5A:
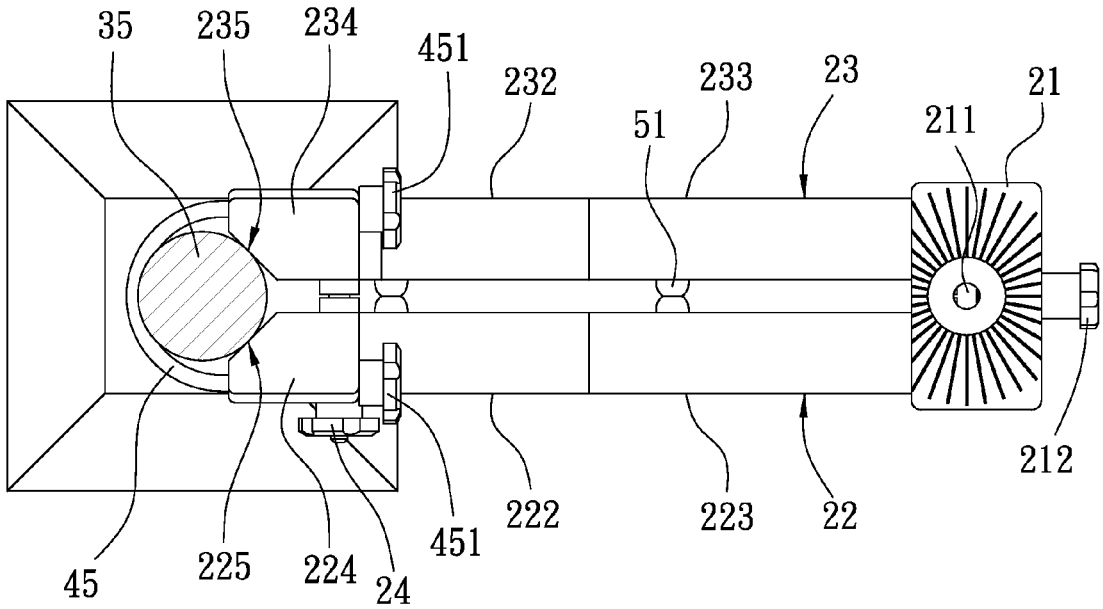
FIG. 5A is a top, partial, cross-sectional view of the mounting bracket in the folding state shown in FIG. 5, which is cooperated with the fixing device.

Referring to FIGS. 1A, 5, 5A, in the illustrated embodiment, the folding mounting bracket 2 can be mounted on a mast 35 by use of the fixing device 4. The fixing device 4 includes a U-shaped screw 45 and two corresponding screw caps 451. In addition, the first frame 22 further includes an erect portion 224 connecting to the transverse portion 222. The erect portion 224 is substantially vertical to the transverse portion 222 of the first frame 22. A corner of the erect portion 224 is cutout along the extending direction of the erect portion 224, thereby forming an attaching portion 225 at an inner side of the erect portion 224. Thus, the erect portion 224 has a suitable configuration to attach to the surface of the mast 35. The second frame 23 includes a erect portion 234 connecting to the transverse portion 232. The fixing portion 234 is substantially vertical to the transverse portion 232 of the second frame 23. A corner of the erect portion 234 is cut out along the extending direction of the erect portion 234, thereby forming an attaching portion 235 at an inner side of the erect portion 234. Thus, the erect portion 234 has a suitable configuration to attach to the surface of the mast 35. The two erect portions 224, 234 face to each other. The mast 35 is surrounded by in the U-shaped screw 45 and the two erect portions 224, 234 and is attached to the two attaching portion 225, 235 of the two erect portions 224, 234. Then the screw caps 451 are cooperated with the U-shaped screw 45 to fasten the mounting bracket 2 in the folding state on the mast 35.

Additionally, the mounting bracket 2 in the folding state has two surfaces facing to each other. One surface is located on the first frame 22, and the other surface is located on the second frame 23. Each surface defines a slot 52 therein. A stable wing 53 is rotatably pivoted in the slot 52. The slot 52 is configured for containing the corresponding stable wing 53. Referring to FIG. 2, when the stable wings 53 are used, they are extended from the first frame 22 and the second frame 23 respectively so as to increase stability of the mounting bracket 2 in the extending state.

Further, the mounting bracket 2 in the folding state has two surfaces facing to each other. When the first frame 22 and the second frame 23 are both in the horizontal position to make the mounting bracket 2 in the extending state, the two surfaces are actually located at the bottom of the mounting bracket 2 in the extending state. The two surfaces have a number of cushions 51 disposed thereon. The cushions 51 can be made of a material selected from a group consisting of silicone, rubber and soft plastics. The cushions 51 of the mounting bracket 2 in the extending state are located at the bottom of the mounting bracket 2 in the extending state and contact with the plane 31 so as to protect the mounting bracket 2 in the extending state and increase stability of the mounting bracket 2 in the extending state. The cushions 51 of the mounting bracket 2 in the folding state are located two surfaces facing to each other of the mounting bracket 2 in the folding state, thereby forming a gap 27 between the first frame 22 and the second frame 23 of the mounting bracket 2 in the folding state. The gap 27 can be configured for receiving the coupling rod 43 or other fixing associated device.

The satellite dish antenna assembly can be used readily anywhere. The mounting bracket can be changed from the extending state to the folding state. The mounting bracket in the extending state can be mounted on a plane. The mounting bracket in the folding state can be mounted on an edge of the plate, a surface of the plate or a mast by cooperating with various fixing devices. Accordingly, the mounting bracket of the satellite dish antenna assembly has a number of mounting functions.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A mounting bracket for a satellite dish antenna, comprising:

a mounting base for mounting the satellite dish antenna thereon;

a first frame comprising a pivoting portion at one end thereof, the pivoting portion being pivoted to one side of the mounting base so that the pivoting portion being capable of rotating from a horizontal position to a vertical position; and a second frame comprising a pivoting portion at one end thereof, the pivoting portion being pivoted to another side of the mounting base opposite to the one side of mounting base so that the pivoting portion being capable of rotating from a horizontal position to a vertical position;

wherein the first frame and the second frame are capable of rotating in the horizontal position simultaneously by rotating the respective pivoting portion, thereby making the mounting bracket in an extending state, and the first frame and the second frame are also capable of rotating in the vertical position simultaneously by rotating the respective pivoting portion, thereby making the mounting bracket in a folding state.

2. The mounting bracket as claimed in claim 1, further comprising a fixing device for cooperating with the mounting bracket in the folding state.

3. The mounting bracket as claimed in claim 2, wherein the fixing device is configured for cooperating with the mounting bracket in the folding state to mount the satellite dish antenna on an edge of a plate, the fixing device comprises:

an upper clamping member located on the mounting bracket in the folding state, the upper clamping having a first rim and a second rim, the first rim and the second rim attaching to two opposite sides of the mounting bracket in the folding state;

a lower clamping member located on a bottom surface of the plate; and a coupling rod for connecting the upper clamping member and the lower clamping member, the coupling rod comprising a bending portion, an upper portion upwardly vertically extending from the upper end of the bending portion and a lower portion transversely horizontally extending from the lower end of the bending portion, the lower portion being installed in the lower clamping member, the bending portion being around the edge of the plate, the upper portion passing through the mounting bracket in the folding state and the upper clamping member, and the upper portion having a screw thread section for cooperating with a screw cap so as to fasten the fixing device.

4. The mounting bracket as claimed in claim 2, wherein the fixing device is configured for cooperating with the mounting bracket in the folding state to mount the satellite dish antenna on a surface of a vertical plate, the fixing device comprises a sucker and a control member having a hanging latch, the first frame further comprises an erect portion substantially vertical thereto, the second frame further comprises an erect portion substantially vertical thereto, the two erect portions face to each other, and a hanging groove corresponding to the hanging latch is defined between the two erect portions and configured for hanging the hanging latch of the control member.

5. The mounting bracket as claimed in claim 4, wherein the control member comprises a supporting portion extending from the side of the control member near to the sucker.

6. The mounting bracket as claimed in claim 2, wherein the fixing device is configured for cooperating with the mounting bracket in the folding state to mount the satellite dish antenna on a mast, the fixing device comprises a U-shaped screw and two corresponding screw caps, the first frame further comprises an erect portion substantially vertical thereto, a corner of the erect portion of the first frame is cut out along the extending direction of the erect portion of the first frame, thereby forming an attaching portion at an inner side of the erect portion of the first frame, the second frame further comprises an erect portion substantially vertical thereto, a corner of the erect portion of the second frame is cut out along the extending direction of the erect portion of the second frame, thereby forming an attaching portion at an inner side of the erect portion of the second frame, the two erect portions face to each other, the U-shaped screw and the two erect portion cooperate for surrounding the mast so that the mast attach to the two attaching portion of the two erect portions, and the U-shaped screw is cooperated with the corresponding screw caps so as to fasten the mounting bracket in the folding state on the mast.

7. The mounting bracket as claimed in claim 1, wherein the first frame comprises a transverse portion and a slant portion, the pivoting portion of the first frame extends from the slant portion, the slant portion of the first frame is located between the pivoting portion and the transverse portion of the first frame, the second frame comprises a transverse portion and a slant portion, the pivoting portion of the second frame extends from the slant portion of the second frame, and the slant portion of the second frame is located between the pivoting portion and the transverse portion of the second frame.

8. The mounting bracket as claimed in claim 1, wherein the mounting bracket in the folding state has two surfaces facing to each other, the two surfaces have a plurality of cushions disposed thereon, the cushions is configured for forming a gap between the first frame and the second frame when the mounting bracket is in the folding state, and the cushions is also configured for attaching to a plane when the mounting bracket is in the extending state.

9. The mounting bracket as claimed in claim 1, further comprising a coupling member for coupling the first frame and the second frame of the mounting bracket in the folding state.

10. The mounting bracket as claimed in claim 9, the coupling member comprises a screw and a screw cap cooperated with the screw.

11. The mounting bracket as claimed in claim 1, wherein the mounting bracket in the folding state has two surfaces facing to each other, each surface defines a slot therein, and a stable wing is rotatably pivoted in the slot.

12. The mounting bracket as claimed in claim 1, wherein the mounting base defines a hole, the hole is configured for installing the satellite dish antenna therein so that the satellite dish antenna is capable of rotating in 360 degrees in the hole, a fastening screw is disposed at a side of the mounting base and configured for fastening the satellite dish antenna in the hole.

13. The mounting bracket as claimed in claim 1, further comprising an adjusting mechanism disposed between the antenna and the antenna base, the adjusting mechanism being configured for adjusting an elevation angle of the antenna, the adjusting mechanism comprising:

a pair of symmetrical bearing plates, each of the bearing plate defining an arc-shaped elongate hole therein;

a bearing arm for supporting and fixing the antenna, the bearing arm being rotatably coupled to the pair of bearing plates via a rotating shaft; and a locking screw having a screw cap cooperating therewith, the locking screw passing through the bearing arm and the arc-shaped elongate holes of the bearing plates so that the locking screw be capable of being movable in the arc-shaped elongate hole and the bearing arm be capable of being rotatable relative to the antenna base, the locking screw cooperating with the screw cap so as to fix the antenna in a certain position with a suitable elevation angle.

14. A satellite dish antenna assembly, comprising a mounting bracket and an antenna coupling to the mounting bracket, the mounting bracket comprising:

a mounting base for mounting the satellite dish antenna thereon;

a first frame comprising a pivoting portion at one end thereof, the pivoting portion being pivoted to one side of the mounting base so that the pivoting portion being capable of rotating from a horizontal position to a vertical position; and a second frame comprising a pivoting portion at one end thereof, the pivoting portion being pivoted to another side of the mounting base opposite to the one side of mounting base so that the pivoting portion being capable of rotating from a horizontal position to a vertical position;

wherein the first frame and the second frame are capable of rotating in the horizontal position simultaneously by rotating the respective pivoting portion, thereby making the mounting bracket in an extending state, and the first frame and the second frame are also capable of rotating in the vertical position simultaneously by rotating the respective pivoting portion, thereby making the mounting bracket in a folding state.

15. The satellite dish antenna assembly as claimed in claim 14, further comprising an antenna base for supporting the antenna, the antenna base having a shaft connecting to the bottom thereof, the mounting base defining a hole therein, the hole being configured for receiving the shaft therein so that the antenna is capable of rotating in 360 degrees in the hole, and a fastening screw being disposed at a side of the mounting base and configured for fastening the shaft in the hole.

16. The satellite dish antenna assembly as claimed in claim 14, further comprising an adjusting mechanism disposed between the antenna and the antenna base, the adjusting mechanism being configured for adjusting an elevation angle of the antenna, the adjusting mechanism comprising:

a pair of symmetrical bearing plates, each of the bearing plate defining an arc-shaped elongate hole therein;

a bearing arm for supporting and fixing the antenna, the bearing arm being rotatably coupled to the pair of bearing plates via a rotating shaft; and a locking screw having a screw cap cooperating therewith, the locking screw passing through the bearing arm and the arc-shaped elongate holes of the bearing plates so that the locking screw be capable of being movable in the arc-shaped elongate hole and the bearing arm be capable of being rotatable relative to the antenna base, the locking screw cooperating with the screw cap so as to fix the antenna in a certain position with a suitable elevation angle.

17. The satellite dish antenna assembly as claimed in claim 14, further comprising a fixing device for cooperating with the mounting bracket in the folding state, wherein the fixing device is configured for cooperating with the mounting bracket in the folding state to mount the satellite dish antenna on an edge of a plate, the fixing device comprises:

an upper clamping member located on the mounting bracket in the folding state, the upper clamping having a first rim and a second rim, the first rim and the second rim attaching to two opposite sides of the mounting bracket in the folding state;

a lower clamping member located on a bottom surface of the plate; and a coupling rod for connecting the upper clamping member and the lower clamping member, the coupling rod comprising a bending portion, an upper portion upwardly vertically extending from the upper end of the bending portion and a lower portion transversely horizontally extending from the lower end of the bending portion, the lower portion being installed in the lower clamping member, the bending portion being around the edge of the plate, the upper portion passing through the mounting bracket in the folding state and the upper clamping member, and the upper portion having a screw thread section for cooperating with a screw cap so as to fasten the fixing device.

18. The satellite dish antenna assembly as claimed in claim 14, further comprising a fixing device for cooperating with the mounting bracket in the folding state, wherein the fixing device is configured for cooperating with the mounting bracket in the folding state to mount the satellite dish antenna on a surface of a vertical plate, the fixing device comprises a sucker and a control member having a hanging latch, the first frame further comprises an erect portion substantially vertical thereto, the second frame further comprises an erect portion substantially vertical thereto, the two erect portions face to each other, and a hanging groove corresponding to the hanging latch is defined between the two erect portions and configured for hanging the hanging latch of the control member.

19. The satellite dish antenna assembly as claimed in claim 18, wherein the control member comprises a supporting portion extending from the side of the control member near to the sucker.

20. The satellite dish antenna assembly as claimed in claim 14, further comprising a fixing device for cooperating with the mounting bracket in the folding state, wherein the fixing device is configured for cooperating with the mounting bracket in the folding state to mount the satellite dish antenna on a mast, the fixing device comprises a U-shaped screw and two corresponding screw caps, the first frame further comprises an erect portion substantially vertical thereto, a corner of the erect portion of the first frame is cut out along the extending direction of the erect portion of the first frame, thereby forming an attaching portion at an inner side of the erect portion of the first frame, the second frame further comprises an erect portion substantially vertical thereto, a corner of the erect portion of the second frame is cut out along the extending direction of the erect portion of the second frame, thereby forming an attaching portion at an inner side of the erect portion of the second frame, the two erect portions face to each other, the U-shaped screw and the two erect portion cooperate for surrounding the mast so that the mast attach to the two attaching portion of the two erect portions, and the U-shaped screw is cooperated with the corresponding screw caps so as to fasten the mounting bracket in the folding state on the mast.

* * * * *